US006807703B2

(12) United States Patent
van Gelder et al.

(10) Patent No.: US 6,807,703 B2
(45) Date of Patent: Oct. 26, 2004

(54) TOOTHBRUSH

(75) Inventors: Maria van Gelder, Twickenham (GB); Kirstie Jane Morgan, Twickenham (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/321,225

(22) Filed: Dec. 17, 2002

(65) Prior Publication Data

US 2003/0084533 A1 May 8, 2003

Related U.S. Application Data

(63) Continuation of application No. 09/837,236, filed on Apr. 18, 2001, now Pat. No. 6,505,373, which is a continuation of application No. 08/765,572, filed as application No. PCT/US95/08740 on Jul. 12, 1995, now Pat. No. 6,219,874.

(30) Foreign Application Priority Data

Jul. 13, 1994 (GB) ..... 9414140

(51) Int. Cl.[7] ..... A46B 9/04; A46B 5/00

(52) U.S. Cl. ..... 15/167.1; 15/172; 15/201

(58) Field of Search ..... 15/167.1, 172, 15/201

(56) References Cited

U.S. PATENT DOCUMENTS

| | | | | |
|---|---|---|---|---|
| 1,337,173 | A | * | 4/1920 | White |
| 2,244,098 | A | * | 6/1941 | Busick |
| 5,355,546 | A | * | 10/1994 | Scheier |
| 5,651,158 | A | * | 7/1997 | Halm |
| 5,774,923 | A | * | 7/1998 | Halm |
| 5,813,079 | A | * | 9/1998 | Halm |
| 6,178,582 | B1 | * | 1/2001 | Halm |

* cited by examiner

*Primary Examiner*—Randall Chin
(74) *Attorney, Agent, or Firm*—James C. Vago

(57) ABSTRACT

A toothbrush, having a handle and a resiliently flexible bristle-bearing head wherein, when the toothbrush is in its normal stress-free configuration, the free ends of bristles lying along a longitudinal and/or transverse axis of the brush form a generally concave profile adapted to suit the buccal surface of the teeth. The toothbrush head can flexibly conform to a convex profile to suit the labial surface of the teeth or to avoid damage to the gums.

20 Claims, 3 Drawing Sheets

TOOTHBRUSH

This application is a continuation of U.S. application Ser. No. 09/837,236 filed Apr. 18, 2001 now U.S. Pat. No. 6,505,373, which is a continuation of U.S. application Ser. No. 08/765,572 filed Jan. 13, 1997 now U.S. Pat. No. 6,219,874, which was the National Stage of International Application No. PCT/US95/08740, filed Jul. 12, 1995, the substances of which are incorporated herein by reference.

FIELD OF THE INVENTION

The present invention relates to toothbrushes, more particularly to toothbrushes which comprise a flexible brush head with a generally concave bristle surface (i.e. the surface defined by the free ends of the bristles) in order to conform the toothbrush to the curvature of human teeth.

BACKGROUND OF THE INVENTION

The configuration of human teeth requires that the ideal bristle contour for toothbrushes for brushing the buccal or outside surfaces of teeth be concave and that the ideal bristle contour for brushing the lingual or inside surfaces of teeth be convex. Most brushes have a single piece head which is of comparable thickness to the handle and which, consequently, is relatively rigid and of a fixed curvature or configuration. Some brushes may, however, incorporate a means for allowing the head to flex relative to the handle, as described for example in EP-A-371,293. Even so, such brushes have limited effectiveness. Other brushes are known which are adjustable into several different but fixed configurations. Adjustable toothbrushes are often difficult to manipulate and may be unreliable.

A further drawback of conventional brushes is that pressing the brush sufficiently hard against the teeth to get good cleaning risks damaging or discomforting the softer, adjacent gums. To a certain extent this can be solved by modifying the configuration of the brush, or by varying bristle hardness or length, though again, a single configuration cannot be optimum for all circumstances.

U.S. Pat. No. 4,712,267, issued to Cheng, discloses a convertible toothbrush comprising an S-shaped elongated handle of shape-retaining material having curved end regions of opposite curvature, a flexible brush block containing bristles, and a means for mounting the flexible brush block on the handle for longitudinal movement along the length of the handle. The curved portions of the handle bend the flexible block and bristles into a concave or convex configuration which corresponds to the curved configuration of the handle.

EP-A-454,625, assigned to Warner-Lambert Company, describes an adjustable curvature toothbrush whose head is in the form of a loop. A cam or slide mechanism changes the curvature of the head between concave and convex configurations. In an alternative embodiment, the head is an integral part of the handle which is in the form of a compressible closed loop, the bristle surface being in a concave configuration when the handle is in its uncompressed state, becoming convex when the handle is compressed.

EP-A-577,656, to Lingner & Fischer GmbH, discloses a toothbrush having a handle and at one end thereof a bristle-bearing head, wherein the head is in the form of two or more segments flexibly and resiliently linked to each other and/or to the handle, one or more of the segments being bristle bearing. In one embodiment this is achieved by the use of transverse, and optionally longitudinal, grooves on the opposite face of the head to the bristles. Under application of pressure in use the brush head may adopt a convex configuration. In another embodiment the handle extends into a frame into whose interior the head is resiliently linked. When pressure is applied to the centre of the brush head it adopts a concave configuration.

While the above toothbrushes provide brush heads with some degree of flexibility, none of them is entirely satisfactory, in particular, they either fail to provide both convex and concave configurations within the one embodiment or they require undue manipulation or skill on behalf of the user.

It is accordingly an object of this invention to provide a toothbrush with a head which can flexibly conform to either the convex or concave surfaces of the teeth and which provides good cleaning and is easy to manufacture and use.

It is a further object of the invention to provide a toothbrush which can clean the teeth efficiently with minimal damage to adjacent gum tissue.

SUMMARY OF THE INVENTION

According to one aspect of the present invention there is provided a toothbrush, having a handle and a resiliently flexible bristle-bearing head wherein, when the toothbrush is in its normal stress-free configuration, the free ends of bristles lying along a longitudinal and/or transverse axis of the brush form a generally concave profile.

The toothbrush head of this invention, being flexible, can flex under the action of toothbrushing so as to accommodate itself to the differing profiles of individual users teeth. In particular, the flexible head of the toothbrush of the present invention has, in its normal stress-free configuration, a bristle profile adapted to suit the buccal surface of the teeth but, at least in preferred embodiments, can bend continuously through a flat position to a convex configuration to accommodate the lingual surface of the teeth generally better than would be the case with a conventional rigid-headed toothbrush. The head may be adapted in such a way that the outer rows of bristles can flex away from the centre to limit the pressure applied to gums when the brush head is pressed against the teeth. In all cases the head is resilient, so that when an applied force is removed, the brush head returns to its original configuration.

DETAILED DESCRIPTION OF THE INVENTION

The toothbrushes of the invention take the form of an elongated handle with, as an essential component, a resiliently flexible bristle-bearing head. At least a first part of the head is formed as an integral extension to the handle. At least one area of this part of the head is sufficiently thin that the head will bend under normal brushing forces. Preferably, the head further comprises one or more areas of a second, elastomeric material formed in or around the first part of the head, so that the whole head has a conventional, generally flattened shape but remains flexible when compared to that of a conventional brush. By flexible is meant herein that when a normal brushing force (2–4 Newtons) is applied to one end of the head, the other end being held fixed, the end to which the force is applied will deflect through an angle of at least 1 degree (the flex angle). In preferred embodiments the flex angle is at least 5 degrees, more preferably at least 10 degrees and it can be as high as 45 degrees or more. In highly preferred embodiments the flex angle is such that the head is able to bend through into a convex configuration. At least one face of the head has bristles attached thereto.

The handle of the toothbrush of the invention, and that part of the head which is an extension of the handle may be made of materials which are conventional in the manufacture of toothbrushes, especially plastics materials. Suitable plastics materials include, for example, polyamides and polypropylenes. An example of a suitable polypropylene is the material 'Polypropylene PM 1600' (marketed by Shell), having a modulus of elasticity (ISO 178) of 1500 MPa and a hardness (ISO 868) of 75 Shore A. The handle itself is generally rigid and may be of a shape which is conventional in the manufacture of toothbrushes. Optionally, the handle may comprise a neck portion which is more flexible than the rest of the handle, as known in the art, provided that it is sufficiently rigid that, in use, when force is applied to the head, particularly when brushing the teeth, the head may still flex in the manner and to the extent described above.

In a preferred aspect of the invention, the head has one or more bristle-bearing faces and at least one bristle-bearing face of the head forms a generally concave configuration when the brush is in its normal unstressed state. The face of the head may be concave along either or both of the transverse and longitudinal axes of the head. Where the face is concave along the longitudinal axis, the radius of curvature may vary along the length of the head. The radius of curvature is preferably from 10 to 500 mm, more preferably from 15 to 250 mm, especially from 25 to 150 mm.

In one embodiment the first part of the head comprises one or more extensions which are integral with the handle, and of such thickness that the desired flexibility is achieved whilst maintaining structural integrity of the head under expected conditions of use. The extensions are generally substantially thinner than the handle. Preferably there is only one such extension. The head may vary in thickness along its length in order to control the profile obtained as the head is flexed under external bending forces. In this embodiment the head extensions are preferably at least partially, and more preferably wholly, surrounded by an elastomeric material, said material also filling any gaps between multiple extensions. The extension(s) may carry some surface ribbing or detailing to assist the adhesion of the elastomer to them.

In yet further embodiments the head has a pair of opposing faces with bristles mounted on one of said pair and the same and/or the opposite face having one or more linear or non-linear grooves therein. The grooves create thin hinges which make the head flexible, the portions of the head between the grooves preferably being of comparable thickness to a conventional non-flexible head.

The grooves can be oriented generally transverse or parallel to the longitudinal axis of the handle and can follow generally curved or zig-zag paths. In particular the grooves may run longitudinally along the head to allow the outer longitudinal rows of bristles to flex away from the inner ones. Preferably there will instead or in addition be transverse grooves so that the head can bend along the longitudinal axis.

The grooves can be of variable width and depth and the distances between grooves can also be varied. In this manner the flexibility of the head along the length and/or across the breadth of the head can be modified. Preferably only the transverse grooves are varied in this way.

One or more of the grooves, preferably all, can be wholly or partially filled with an elastomeric material. In this way too the flexibility and/or resilience of the head may be varied and contamination of the grooves by, for example, toothpaste deposits may be reduced or avoided completely. The colour of the elastomeric material may be the same as that of the material of the head, or it may be different thereby achieving a distinctive striped or otherwise patterned appearance.

The grooves may be generally straight or they may follow curved or zig-zag paths. Non-linear grooves help to offset compression stress in the elastomeric material filling the grooves as the head bends.

Suitable elastomeric materials herein are thermoplastic elastomers with a Shore hardness of 30–80 such as Santoprene and Thermoflex. A particularly suitable elastomer is 'PTS Thermoflex 75' (marketed by Plastic Technologie Service, Germany), having a modulus of elasticity (ISO 178) of 100 MPa and a hardness (ISO 868) of 80 Shore A. The elastomers may optionally be mixed with a suitable plasticiser or foaming agent to make them more compressible.

The bristles can be made of any of the materials well known in the art. Suitable bristle materials herein are polyester and nylon, such as Dupont Nylon 612. The bristles are preferably of circular cross-section but can also be of other cross-sections including, but not limited to, rectangular, hexagonal and trilobular. Furthermore, the diameter and length of the bristles can vary within the usual dimensions known by a person skilled in the art, provided that, when the brush is in the unstressed state, the overall objective of having a generally concave bristle surface is still met. The bristles are generally conventionally grouped into tufts and can be attached to the brush head by a variety of processes. Preferred processes herein are stapling and fusion. The bristles can be inserted into either or both of the head extension and the elastomeric material. Cutting and end-rounding of the bristles can be done using any of the methods commonly known in the art.

In use, the toothbrush of this invention can be used for cleaning the teeth by an entirely conventional toothbrushing hand action, preferably in a manner recommended by dental health authorities. The toothbrush of the invention can also be used in electrically driven toothbrushes or children's toothbrushes.

The invention will now be described by way of example only, with reference to the accompanying drawings in which.

Figure 7:
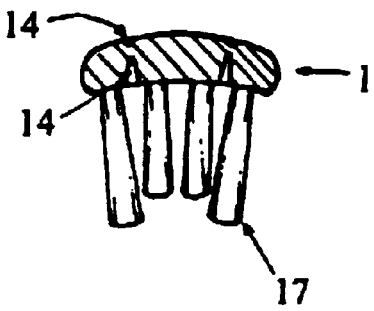

FIG. 7 is a transverse section through a toothbrush head constituting a sixth embodiment with two longitudinal grooves on each face. The head is pre-formed so that its face is naturally concave along the transverse axis. The grooves are filled with elastomer.

Figure 8:
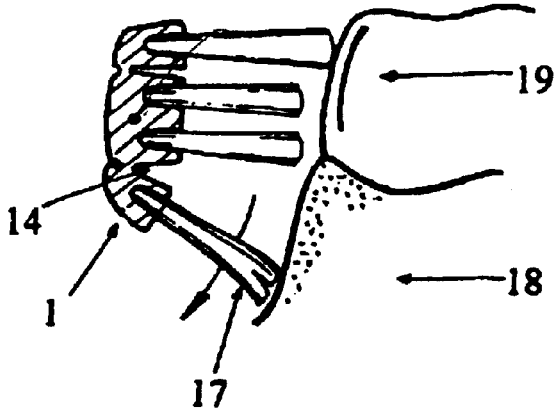

FIG. 8 shows how the longitudinal outer rows of the brush head of FIG. 7 can flex away from the gums as force is applied when brushing.

Figure 9:
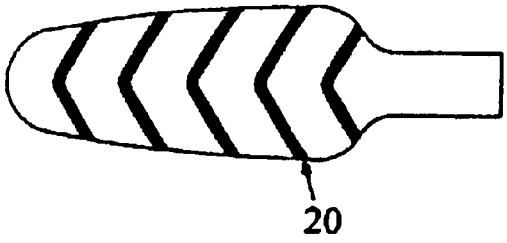
Figure 10:
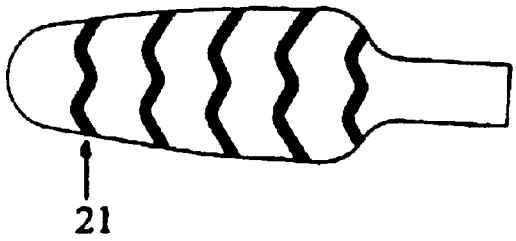

FIGS. 9 and 10 are plan views of heads constituting further embodiments with chevron-like and waved transverse, elastomer-filled grooves.

Figure 11:
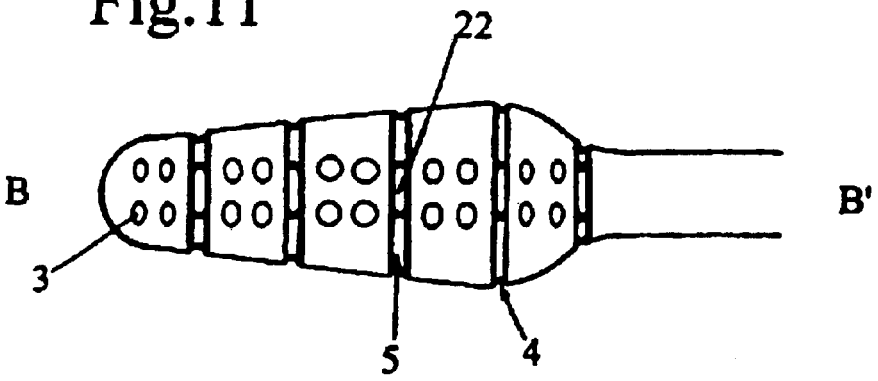

FIG. 11 is a partial plan view of a still further embodiment whose head has transverse grooves wherein, along the centre line of the head, the grooves are the full depth of the head so that two rows of approximately parallel hinges are created.

Figure 12:
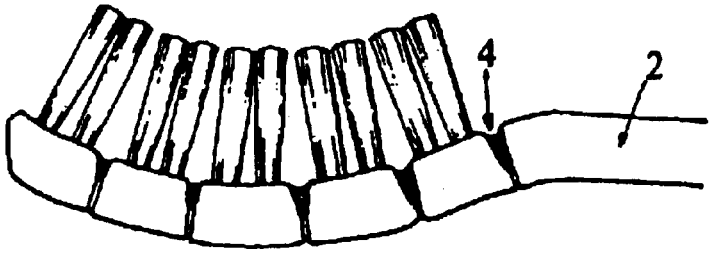

FIG. 12 is a partial side view of yet another embodiment showing a side view of a head with variable depth grooves, giving greater flexiblility nearer the neck of the brush.

Figure 1:
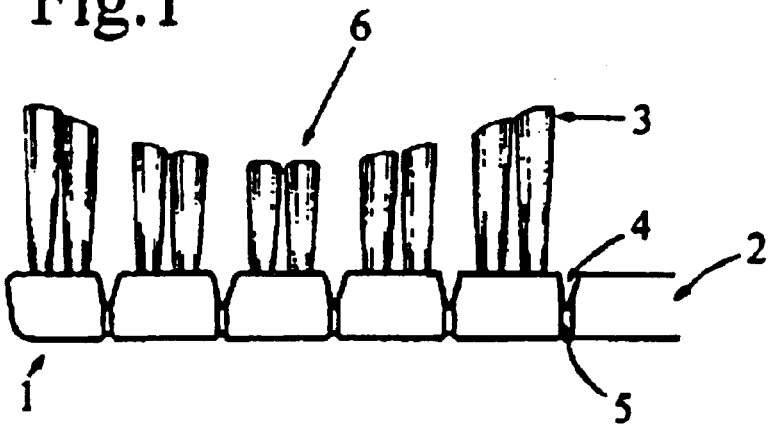
FIG. 1 is a partial side view of a first embodiment of the invention, depicting a toothbrush head with transverse grooves. Although the head is flat in its unstressed state, the bristles are cut to different lengths so that the bristle surface is concave along the longitudinal direction.

Referring to FIG. 1, a toothbrush head (1) is formed integrally at one end of a handle (2). The head (1) has two substantially parallel faces, and in a top face are mounted bristles distributed in a plurality of tufts (3). The upper and lower faces carry a number of generally parallel transverse grooves (4), leaving a thin, flexible hinge of head material (5). The bristles are cut so that the bristle surface (6) is concave when the brush is in its natural unstressed state.

Figure 2:
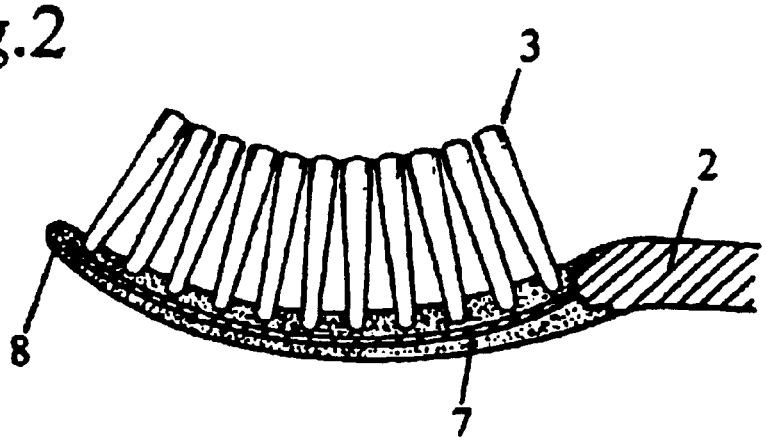
FIG. 2 is a similar view of a second embodiment illustrating a toothbrush head where the first part is formed by a single extension integral with the handle and is further surrounded by elastomer. The head is pre-formed so that it is naturally concave in its unstressed state.

In FIG. 2 a first part of the brush head is formed by a single thinned extension (7) of the handle (2). The extension is surrounded by an elastomer (8) so that the whole head is of comparable thickness to a conventional brush. The head is pre-formed into a naturally concave configuration but is sufficiently flexible that, under normal brushing forces the head can be made to bend back into a convex configuration. The bristle tufts (3) in this example are of approximately equal length and are fused into the elastomeric material.

Figure 3:
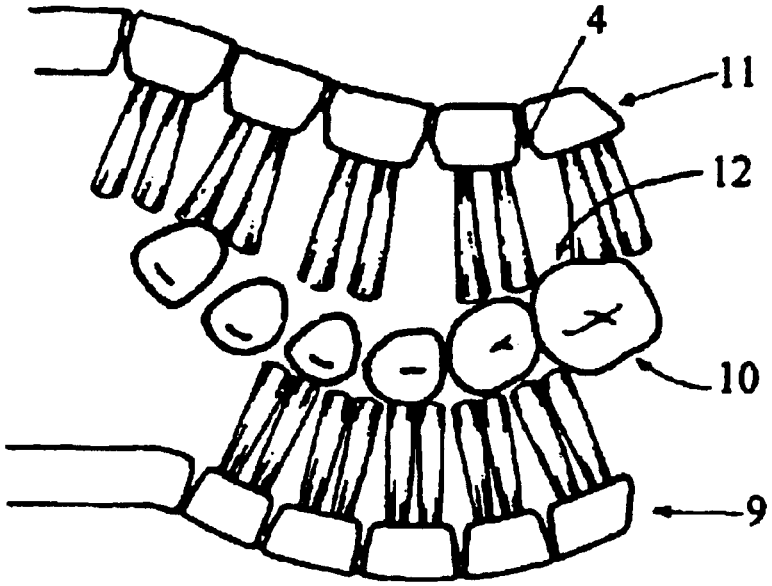
FIG. 3 is a partial side view of a third embodiment showing a grooved toothbrush head, the face of which is concave in its unstressed configuration and illustrating how the toothbrush head can bend from a concave configuration to a convex one to suit both buccal and labial surfaces of the teeth (shown in plan).

In FIG. 3 the head is pre-formed into a naturally concave configuration (9) ideally suited to clean the buccal surface of teeth (10). Transverse grooves (4) confer flexibility on the brush head so that under normal brushing forces the head can be made to bend back into a convex configuration (11) more suited to the labial surface (12) of the teeth. The grooves may additionally be filled with an elastomeric material, optionally of a different colour to the head material to give a distinctive appearance.

Figure 4:
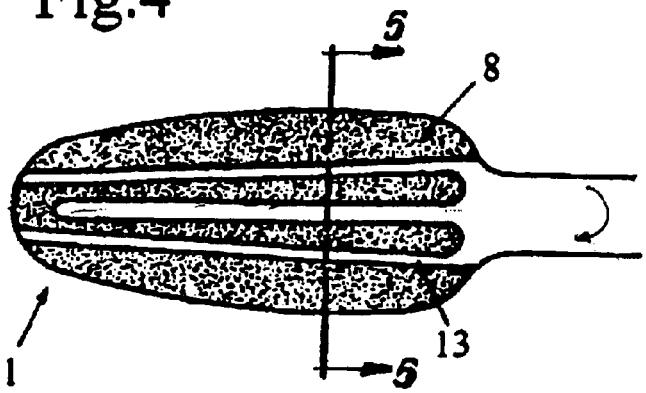
FIG. 4 is a plan view of a toothbrush head, constituting a fourth embodiment of the invention and which comprises three thin longitudinal extensions surrounded by elastomer. The head is able to bend around both longitudinal and transverse axes.
Figure 5:
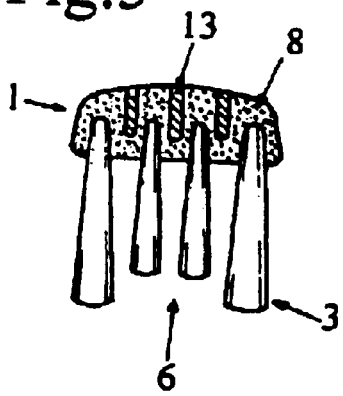
FIG. 5 is a transverse section through the head of FIG. 4 along the line AA'. The bristles are cut so that the bristle surface is naturally concave along the transverse axis.

In FIGS. 4 and 5 the head (1) comprises multiple extensions (13) of the handle, surrounded by elastomer (8) so that the overall shape of the head is conventional, whilst being flexible in both longitudinal and transverse directions. The bristle tufts (3) are shown fused into the elastomer and are cut so that the bristle surface (6) is generally concave.

Figure 6:
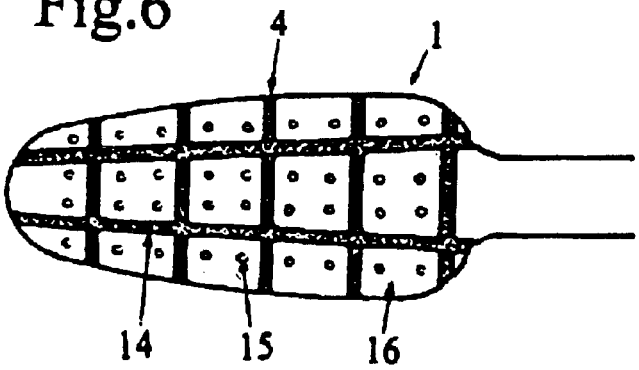
FIG. 6 is a plan view of a fifth embodiment wherein the head has both transverse and longitudinal grooves. The grooves are filled with elastomer.

In FIG. 6, the head (1) carries both transverse (4) and longitudinal (14) grooves. The grooves are filled with elastomer. Holes (15) are drilled into one face of the head in the regions of normal thickness between the grooves (16) to accommodate bristle tufts by a conventional stapling process.

In FIGS. 7 and 8 the head (1) is pre-formed so that it is naturally concave along the transverse axis. Longitudinal grooves (14) on both upper and lower faces of the head confer flexibility. In this way the outer rows of bristles (17) can flex away from the gums (18) as the teeth (19) are brushed, thus avoiding gum damage.

FIGS. 9 and 10 show heads with non-linear, transverse, elastomer-filled grooves. The grooves are in the form of chevrons (20) or waves (21). In both cases, the grooves give the brush a distinctive appearance and, further, help to offset compression stress in the elastomeric material within the grooves as the brush bends. The figures show the back of the head, which becomes compressed as the brush head bends towards a convex configuration.

In FIG. 11 the head has transverse elastomer-filled grooves (4). For clarity the elastomer is not shown. Around the centre axis of the brush BB' the grooves pass right through the brush head (22) leaving a row of hinges (5) on each side of the head. The bristle tufts (3) are conventionally stapled into the thicker parts of the head.

In FIG. 12 the depth of the grooves (4) is shown to increase in the direction towards the handle (2), the deepest grooves being closest to the end of the head nearest to the handle. This results in the part of the head closest to the handle (2) being more flexible by virtue of having thinner hinges than the part of the head furthest from the handle. The grooves are filled with elastomer.

What is claimed:

1. A toothbrush, comprising:

a handle at one end thereof having first and second extensions which are thinner than said handle;

a flexible head formed from an elastomeric material, said first and second extensions have a top, a bottom, and a side surface, wherein said side surface of said first extension and said side surface of said second extension face each other and wherein said elastomeric material is attached to said side surfaces of each of said extensions;

a plurality of bristle tufts extending from said elastomeric material; and wherein said first and second extensions are integrally formed with said handle.

2. The toothbrush of claim 1, wherein said bristle tufts extend across the width and length of said head.

3. The toothbrush of claim 1, wherein said plurality of bristle tufts are fused into said elastomeric material.

4. The toothbrush of claim 1, wherein said first and second extensions have surface ribbing.

5. The toothbrush of claim 1, wherein said elastomeric material has a Shore hardness between 30 and 80.

6. The toothbrush of claim 1, wherein said bead has a flex angle of at least 5 degrees.

7. The toothbrush of claim 1, wherein said head has a flex angle of at least 10 degrees.

8. The toothbrush of claim 1, wherein said head has a flex angle between 10 degrees and 45 degrees.

9. The toothbrush of claim 1, wherein said bristle tufts comprises nylon or polyester.

10. The toothbrush of claim 1, further comprising a third extension.

11. The toothbrush of claim 1, wherein said elastomeric material has an upper bristle-bearing surface and a lower surface opposite said upper bristle-bearing surface and a thickness there between, wherein said thickness of said elastomeric material is greater than said thickness of said extensions.

12. A toothbrush, comprising:

a handle at one end thereof having first and second extensions which are thinner than said handle;

a flexible head formed from an elastomeric material, said first and second extensions have a top, a bottom, and a side surface, wherein said side surface of said first extension and said side surface of said second extension face each other and wherein said elastomeric material is attached to said side surfaces of each of said extensions;

a plurality of bristle tufts extending from said elastomeric material; and wherein said head has a length and said first and second extensions extend substantially along said length of said head.

13. The toothbrush of claim 12, wherein said bristle tufts extend across the width of said head and the length of said head.

14. The toothbrush of claim 12, wherein said plurality of bristle tufts are fused into said elastomeric material.

15. The toothbrush of claim 12, wherein said first and second extensions have surface ribbing.

16. The toothbrush of claim 12, wherein said elastomeric material has a Shore hardness between 30 and 80.

17. The toothbrush of claim 12, wherein said head has a flex angle of at least 5 degrees.

18. The toothbrush of claim 12, wherein said head has a flex angle between 10 degrees and 45 degrees.

19. The toothbrush of claim 12, further comprising a third extension.

20. The toothbrush of claim 12, wherein said elastomeric material has an upper bristle-bearing surface and a lower surface opposite said upper bristle-bearing surface and a thickness there between, wherein said thickness of said elastomeric material is greater than said thickness of said extensions.

* * * * *